US009446819B2

(12) United States Patent
Longueve et al.

(10) Patent No.: US 9,446,819 B2
(45) Date of Patent: Sep. 20, 2016

(54) METHOD FOR DISCHARGING LIQUID FROM A TANK OF A STRICKEN SHIP

(75) Inventors: Gilles Longueve, Boissy-sans-Avoir (FR); Roch Hallopeau, Paris (FR)

(73) Assignee: JLMD ECOLOGIC GROUP, Paris (FR)

( * ) Notice: Subject to any disclaimer, the term of this patent is extended or adjusted under 35 U.S.C. 154(b) by 9 days.

(21) Appl. No.: 14/117,559

(22) PCT Filed: Apr. 4, 2012

(86) PCT No.: PCT/FR2012/050728

§ 371 (c)(1),
(2), (4) Date: Nov. 13, 2013

(87) PCT Pub. No.: WO2012/156601

PCT Pub. Date: Nov. 22, 2012

(65) Prior Publication Data

US 2014/0311584 A1 Oct. 23, 2014

(30) Foreign Application Priority Data

May 13, 2011 (FR) ..... 11 54183

(51) Int. Cl.

| | |
|---|---|
| ***B67B 7/00*** | (2006.01) |
| ***B63B 17/00*** | (2006.01) |
| ***B63B 27/24*** | (2006.01) |
| ***B63C 7/00*** | (2006.01) |
| ***B63B 19/14*** | (2006.01) |
| ***B63B 57/00*** | (2006.01) |

(52) U.S. Cl.

CPC ..... *B63B 17/0036* (2013.01); *B63B 19/14* (2013.01); *B63B 27/24* (2013.01); *B63B 57/00* (2013.01); *B63C 7/006* (2013.01); *Y10T 137/048* (2015.04); *Y10T 137/9138* (2015.04)

(58) Field of Classification Search

CPC ... B63B 17/0036; B63B 19/14; B63B 27/24; B63B 57/00; B63B 19/26; B63B 25/08; B63B 25/082; B63B 2734/00; B63C 7/006; B63C 7/00; B63C 7/16; Y10T 137/048; Y10T 137/9138

See application file for complete search history.

(56) References Cited

U.S. PATENT DOCUMENTS

| | | | | |
|---|---|---|---|---|
| 1,333,783 A * | 3/1920 | Sliwinski | B63C 7/16 114/51 |
| 2,791,357 A | 5/1957 | Nelson | |
| 3,319,574 A * | 5/1967 | Henderson | B63B 13/00 137/206 |

(Continued)

FOREIGN PATENT DOCUMENTS

| | | |
|---|---|---|
| DE | 4213184 A1 | 10/1993 |
| FR | 2398683 A1 | 2/1979 |

(Continued)

OTHER PUBLICATIONS

International Search Report issued Jul. 26, 2012 re: PCT/FR2012/050728.

*Primary Examiner* — Patrick M Buechner
(74) *Attorney, Agent, or Firm* — Cantor Colburn LLP

(57) ABSTRACT

This method for discharging liquid from a tank of a stricken ship that is partially out of the water and has at least one technical access includes the following steps: opening the technical access, introducing a rigid pipe into the interior of the tank through the technical access, and placing a lift pump or a suction pump inside the rigid pipe. The lift pump or suction pump can be without a delivery hose.

8 Claims, 4 Drawing Sheets

(56) References Cited

U.S. PATENT DOCUMENTS

| | | | | | |
|---|---|---|---|---|---|
| 3,831,387 | A * | 8/1974 | Rolleman | B63C 7/006 | 405/191 |
| 3,865,270 | A | 2/1975 | Petersson | | |
| 4,195,653 | A * | 4/1980 | Cessou | B63C 7/006 | 137/13 |
| 4,284,110 | A * | 8/1981 | Divelbiss | B63C 7/006 | 114/50 |
| 4,435,132 | A | 3/1984 | Haesloop et al. | | |
| 4,608,171 | A | 8/1986 | LaValley | | |
| 4,976,278 | A * | 12/1990 | Ripley | B08B 9/0933 | 137/15.16 |
| 5,647,516 | A | 7/1997 | Young et al. | | |
| 5,810,039 | A * | 9/1998 | Wouters | B29C 49/20 | 137/15.16 |
| 2005/0039800 | A1* | 2/2005 | Lothe | B63B 27/24 | 137/592 |
| 2008/0310937 | A1* | 12/2008 | De Baan | B63B 27/24 | 414/137.7 |
| 2010/0032939 | A1* | 2/2010 | Crawford | B63C 7/006 | 285/18 |
| 2010/0183455 | A1 | 7/2010 | Liberg | | |
| 2012/0318370 | A1* | 12/2012 | Verver | B63C 7/006 | 137/13 |

FOREIGN PATENT DOCUMENTS

| | | | |
|---|---|---|---|
| FR | 2515747 | A1 | 5/1983 |
| FR | 2849640 | A1 | 7/2004 |
| FR | 2878225 | A1 | 5/2006 |
| GB | 633619 | A | 12/1949 |
| GB | 2186916 | A | 8/1987 |
| GB | 2385893 | A | 9/2003 |
| WO | 0169033 | A2 | 9/2001 |

* cited by examiner

METHOD FOR DISCHARGING LIQUID FROM A TANK OF A STRICKEN SHIP

TECHNICAL FIELD

The present patent application relates to a method for discharging liquid from a tank of a ship not having pumping means, or having pumping means that are at least partially damaged, and/or requiring additional pumping means.

BACKGROUND

When a ship experiences an incident or a peril of the sea and it is carrying liquid cargo such as hydrocarbons, the question arises of being able to evacuate that cargo so as to prevent it from being immobilized or to avoid major pollution, such as that experienced in recent shipwrecks that has been a major topic in the news.

The techniques used to achieve these goals differ depending on whether the ship is submerged or partially out of the water.

In the first case, i.e., in the case of a completely submerged ship, techniques are traditionally used in which seawater is brought into the tanks where the liquid to be recovered is located: under the effect of the hydrostatic pressure, that seawater chases out the liquid in the tank, which is not miscible with the water, thereby making it easy to recover said liquid through flexible discharge pipes.

In the second case, where the ship remains partially out of the water, it is not possible to use the hydrostatic pressure of the water to recover all of the contents of the tanks, and pumping means must be used to extract the rest of the liquid.

To that end, traditionally, either one lowers pumps into the tanks, the pumps being connected to delivery hoses for lifting liquid toward the outside of the tank, or a pump is placed on the deck provided with a hose to suction the contents of the tank toward the outside.

A lift pump refers to a pump which, submerged in the fluid to be displaced, "pushes" it in the delivery pipe; a suction pump refers to a pump that is placed above the fluid to be displaced and "suctions" it through a depressurization phenomenon of the volume comprised between the pump and the fluid.

In the case where pumps are lowered inside the tanks, it is difficult orient them inside the tanks, and it is not uncommon for them to become jammed behind equipment (channels, ladders, stairs, pumps, etc.) or reinforcing elements (beams, ribs, frames, etc.) situated inside the tanks.

Furthermore, the delivery hoses to which they are connected are massive, and make it awkward and lengthy to install those pumps on the operating sites.

In the case of suction from the deck, physical constraints limit the maximum pumping height.

BRIEF SUMMARY

The present invention thus in particular aims to provide a method for discharging liquid from a tank of a ship that is partially out of the water, not having these drawbacks.

This aim of the invention is achieved with a method for discharging liquid from a tank of a ship that is partially out of the water and has no pumping means, or having pumping means that are at least partially damaged, and/or requiring additional pumping means, said tank including at least one technical access, comprising the steps of:

opening said technical access, introducing a rigid pipe into the interior of the tank through this technical access, placing, inside this rigid pipe, a pump selected from the group comprising a lift pump that is positioned in the lower portion of said pipe, and a suction pump that is positioned in the upper portion of said pipe.

Owing to these features, it is possible to position the pump precisely (as well as its delivery or suction hose, when there is one) inside the tank, and to eliminate the risk of jamming of the pump (and its hose, if applicable), in equipment situated inside the tank.

According to other optional features of the method according to the present invention:

said pump has no delivery or suction hose, and is suitable for being sealably connected with said rigid pipe, such that it is possible to lift or suction said liquid through said rigid pipe: owing to this sealed relationship, it is possible to make said rigid pipe act as a delivery pipe for the liquid located inside the tank, by lifting or suction depending on the type of pump used; in this way, it is possible to eliminate all of the bulk and installation time drawbacks mentioned above regarding the prior art;

when the rigid pipe has a diameter strictly smaller than that of the technical access, said rigid pipe is inclined so as to pump the fluid at different points of the inside of the tank;

when the tank includes several technical accesses, the rigid pipe and the pump, with its associated hose if applicable, are introduced into at least one of said technical accesses;

when the technical accesses are inclined toward the corners of the tank, the rigid pipe and the pump, with its associated hose if applicable, are introduced into the technical accesses so as to pump the liquid located in the corners of the tank;

when said pump is a lift pump, it is lowered into the rigid pipe using a suspension cable;

when said pump is a lift pump, it is lowered into the rigid pipe using its electrical or hydraulic power cable;

when the pump is a lift pump and is equipped with a delivery hose, said pump is lowered into the rigid pipe using its delivery hose;

when the pump is a suction pump and is equipped with a suction hose, the hose connected to said pump positioned on said technical access is lowered into the rigid pipe.

The present invention also relates to a technical access that is particularly suitable for implementing the method according to the invention, remarkable in that it is steerable: this steerable nature makes it possible to orient the rigid pipe in which the pump is placed, in the zones of the tank where one wishes to perform the pumping.

According to optional features of this steerable technical access, considered alone or in combination:

said technical access includes a bellows secured to a platen and suitable for being fixed on said tank;

said technical access is secured to a platen suitable for being rotatably mounted by a ball bearing on an annular plate secured to said tank;

said platen includes annular slots capable of cooperating with screws and nuts secured to an annular plate secured to said tank: this particular arrangement on the one hand allows different angular orientations of the technical access, and on the other hand allows it to be easily assembled/disassembled with respect to the tank so as to avoid corrosion problems in particular of the ball bearings outside operating periods.

BRIEF DESCRIPTION OF THE DRAWINGS

Other features and advantages of the present invention will appear in light of the following description, and upon examining the appended figures, in which.

In all of these figures, identical or similar references designate identical or similar members or sets of members.

DETAILED DESCRIPTION

Figure 1:
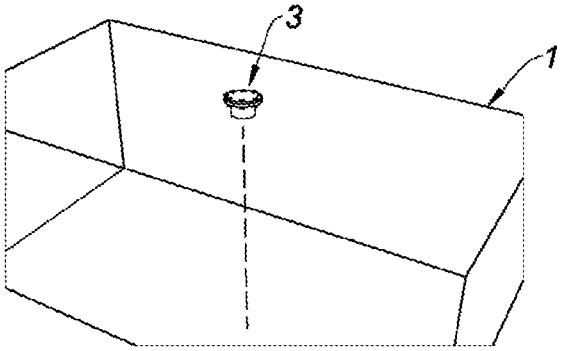
FIG. 1 is a perspective view of a ship tank equipped with a central technical access.

Reference will be made to FIG. 1, which shows a ship tank 1, with a substantially parallelepiped shape, provided on its ceiling, i.e., on its upper wall, with a technical access 3.

This technical access 3 is preferably placed centrally on the ceiling of the tank 1, but is not limited to this arrangement.

The tank 1 is a transport tank for liquids, such as hydrocarbons, equipping a ship including a plurality of such tanks.

The present invention relates to the problem of recovering the liquid located inside that tank when the ship does not have pumping means, or has pumping means that are partially or completely damaged, and/or requires additional pumping means (for example, due to a deterioration of the flow rate of the original pumping means following damage thereof, or due to an original insufficiency of the flow rate of the pumping means), and remains at least partially out of the water.

It is therefore assumed that the technical access 3 remains above the water level, such that it is accessible from the outside to perform the operations to recover the liquid situated inside the tank 1, in accordance with the method that will be described hereafter.

Figure 2:
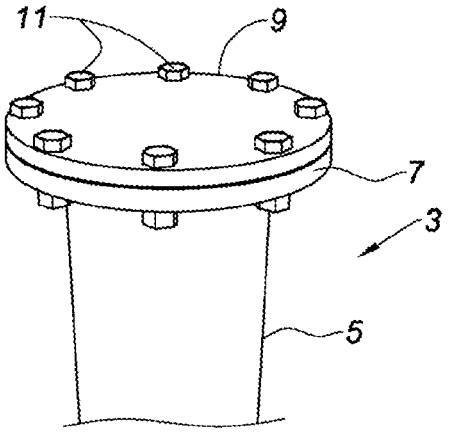
FIG. 2 is an enlarged perspective view of that technical access.
Figure 3:
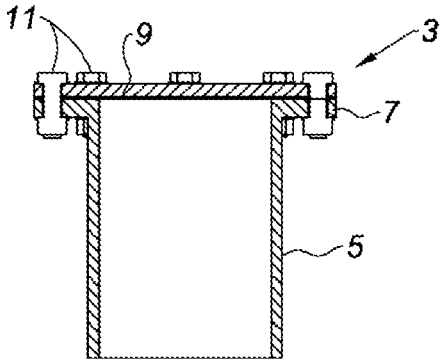
FIG. 3 is a longitudinal cross-sectional view of said technical access, FIG. 4 diagrammatically illustrates the method according to the invention applied to the tank of FIG. 1.

More specifically, as shown in FIGS. 2 and 3, the technical access 3 includes a short pipe segment 5, topped by a flange 7 on which a plug 9 is fixed by multiple screws and nuts 11.

The pipe segment 5 may be made from steel, preferably stainless steel, and welded to the ceiling of the tank 1, and the plug 9 may be made from steel or aluminum, for example but non-limitingly (plastic materials such as PVC also being able to be used).

When the ship equipped with the tank 1 does not have pumping means, or has pumping means that are completely or partially damaged, the technical access 3 is accessed from the outside, i.e., above the surface level of the water, and the plug 9 is unscrewed from the pipe segment 5.

When it is necessary to work more quickly or when the outside conditions require it, it is possible to decide not to unscrew the plug 9, which is then pierced with a commercially available perforating device, which may for example assume the form of a hole saw topped by a valve suitable for cutting the metal.

Therefore, once the plug 9 is gone, it is possible to access the inside of the tank 1 through the pipe segment 5.

Figure 4:
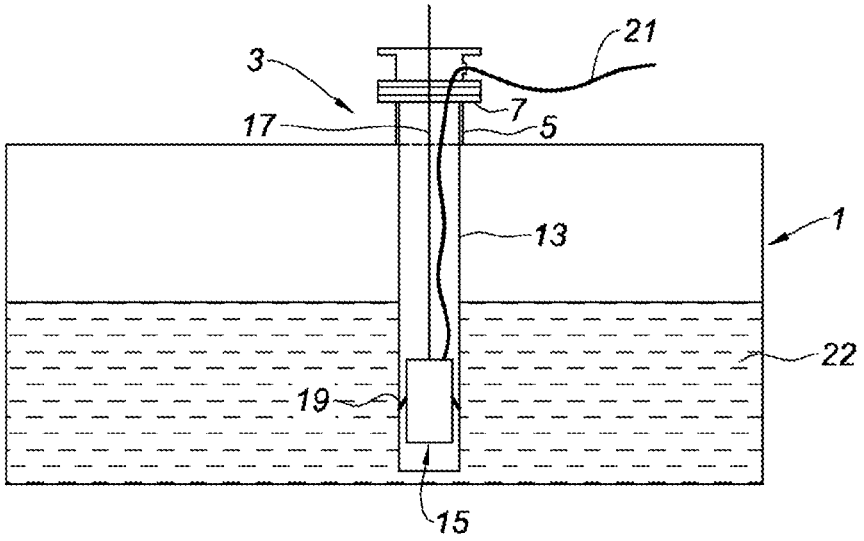

A rigid pipe 13 long enough to substantially reach the bottom of the tank 1 is then inserted into this pipe segment 5, as shown in FIG. 4.

The rigid pipe 13 may be formed by a single tube of predefined length or an assembly of tubes with different lengths facilitating its handling and offering greater flexibility over the length of the final tube.

This rigid pipe 13, which is preferably cylindrical, may be made from a plastic material such as PVC, or a light metal alloy.

Preferably, and as shown in FIG. 4, the diameter of this rigid pipe 13 is strictly smaller than that of the pipe segment 5 of the technical access 3, so as to leave play.

Once this rigid pipe 13 has been placed as shown in FIG. 4:

- either a lift pump 15 is lowered inside said rigid pipe, for example using a winched cable 17 from which said pump is suspended; if this pump 15 is suitable for being in sealed connection with the inner wall of the rigid pipe 13 (see below), the contents of the tank may be removed directly using that rigid pipe; if the pump 15 includes a delivery hose (in which case it is not necessary for it to be in sealed connection with the inner wall of the rigid pipe 13), the liquid to be removed is delivered by said hose;
- or a suction pump 15 is placed; if this pump 15 is suitable for being in sealed connection with the technical access 3 or with the inner wall of the upper part of the rigid pipe 13, the contents of the tank may be suctioned directly by said rigid pipe; if the pump 15 includes a suction hose (in which case it is not necessary for it to be in sealed connection with the technical access or with the inner wall of the rigid pipe 13), the liquid to be removed is suctioned by that hose.

The sealed relationship between the pump 15 and the rigid pipe 13 or the technical access 3 may for example be achieved using a collar 19 placed on the periphery of said pump and bearing against the inner wall of said rigid pipe or said technical access.

Owing to this sealing relationship, neither the outside air nor the liquid 22 situated inside the tank 1 can cross the barrier of that sealing device.

The pump 15 is also connected by one or more cables or lines 21 to an electrical or hydraulic power supply system, necessary for the operation of the pump.

It is useful to specify here that the cables or lines 21 have a small diameter, unlike any delivery or suction hoses for the liquid 22 from the inside of the tank 1 toward the outside thereof, using the pump 15.

Therefore, once the rigid pipe 13 has been inserted inside the tank 1 and the pump 15 inside that pipe as shown in FIG. 4, or on the technical access 3, it is possible to start the pump 15 by sending the fluid (electricity or hydraulic fluid) necessary for the operation of the pump into the cable 21.

This pump thus supplied with energy can perform its suction function, or its delivery function toward the outside, inside the rigid pipe 13 or the hose when one is present.

In the event no delivery or suction hose is inserted in the rigid pipe 13, the sealing provided between the pump 15 and the inner wall of the rigid pipe 13 makes it possible to make said rigid pipe 13 perform the function traditionally performed in the prior art by the delivery or suction hoses of the pumps used to date.

Figure 7:
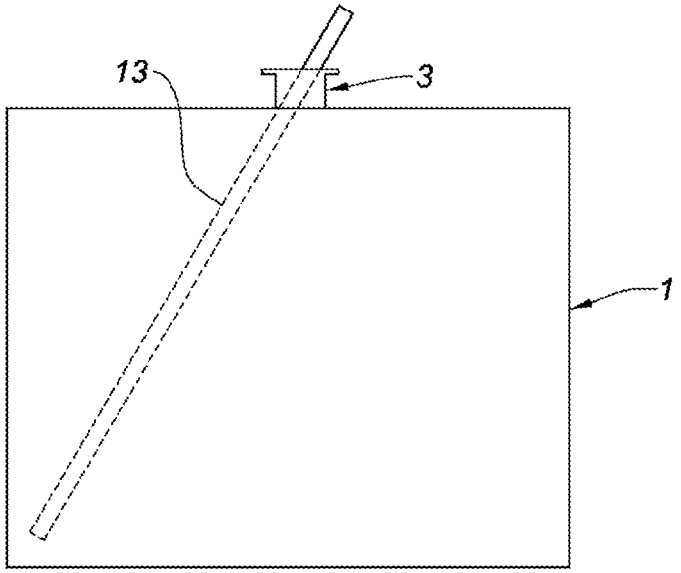
FIG. 7 is a cross-sectional view of a ship tank equipped with a technical access and provided with a rigid pipe inclined so as to pump liquid at a specific point inside the tank.

When the ship does not rest completely horizontally on the bottom or the reef on which it is stricken, it may be necessary to incline the rigid pipe 13 inside the tank 1 to seek out the liquid 22 where it is found: this is made possible by the smaller diameter of the rigid pipe 13 relative to that of the pipe segment 5 of the technical access 3, as indicated in FIG. 7.

As can be understood in light of the preceding, the rigid pipe 13 makes it possible to orient the pump 15 and its associated delivery or suction hose when one is present, exactly where one wishes inside the tank 1, and to prevent any blockage of that pump and/or hose in equipment that may be located inside said tank 1, such as other channels, ladders, stairs, ribs, reinforcing elements, other pumps, etc.

In the event no delivery or suction hose is used, the fact that this pump 15 is only connected to the outside by a flexible suspension cable 17 and by at least one simple electricity or hydraulic fluid supply line 21 allows that pump to be placed very quickly, unlike a traditional pump connected to the outside by a true delivery or suction hose, which is much bulkier and more rigid.

Figure 5:
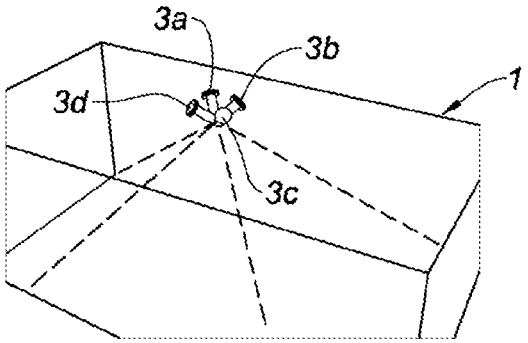
FIG. 5 is a perspective view of a ship tank equipped with a multi-head technical access, each of the heads being oriented toward the corners of the tank.

To facilitate access of the pump 15 in particular in the corners of the tank, it is possible to provide that the technical access 3 includes several heads 3*a*, 3*b*, 3*c*, 3*d* each inclined toward the corners of the tank, as shown in FIG. 5: the dotted lines shown in this FIG. 5 indicate, in this case, the favored directions that the rigid pipe 13 equipped with this pump 15 may occupy.

Figure 6:
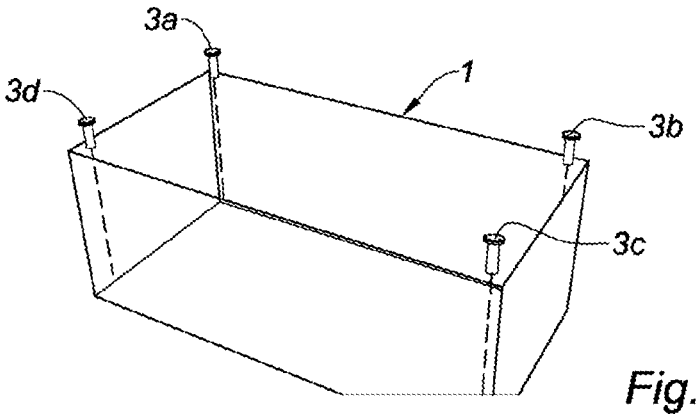
FIG. 6 is a perspective view of a ship tank equipped with multiple technical accesses each positioned in the upper corners of said tank.

According to another alternative visible in FIG. 6, it is possible to provide multiple technical accesses 3*a*, 3*b*, 3*c*, 3*d* each positioned in upper corners of the tank 1, in that case making it possible to position the rigid pipe 13 in the direction indicated by the dotted lines shown in figure.

Of course, the present invention is in no way limited to the embodiments described above, provided as mere examples.

Thus for example, it is possible to consider a technical access particularly suitable for implementing the method according to the invention, remarkable in that it is steerable: this steerable nature makes it possible to orient the rigid pipe in which the pump is placed, in the areas of the tank where one wishes to perform the pumping.

Figure 8:
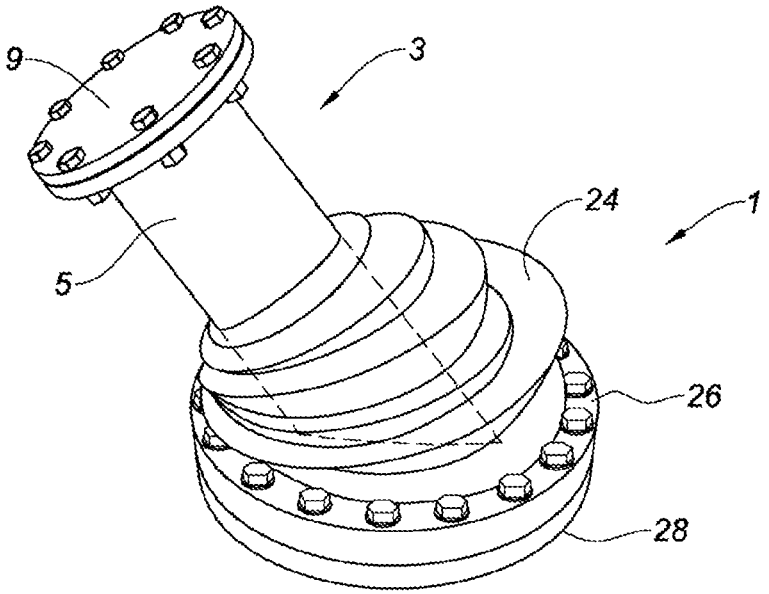
FIG. 8 is a detailed perspective view of a technical access with a bellows.

As shown in FIG. 8, a first manner of producing such a steerable technical access 3 may be to provide that the pipe segment 5 is connected to the tank 1 by a bellows 24 secured to a platen 26 suitable for being fixed on said tank 1; such a bellows, making it possible to achieve sealing of the assembly, may for example be made from rubber.

Figure 9:
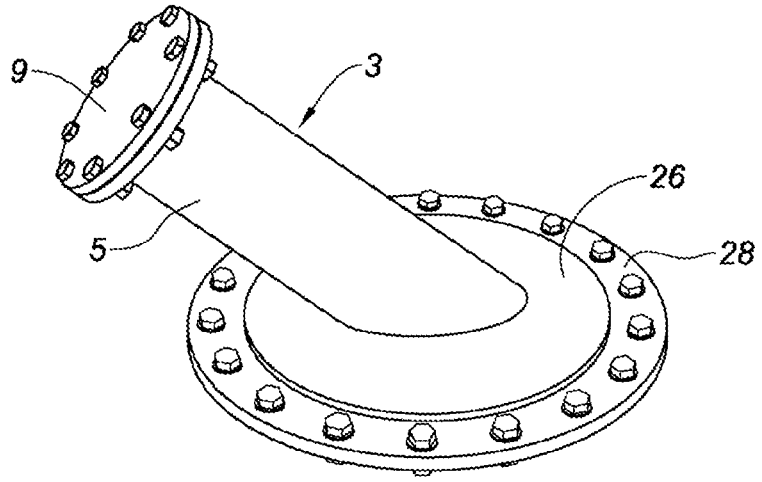
FIGS. 9 and 10 are detailed perspective views of rotary technical accesses.
Figure 10:
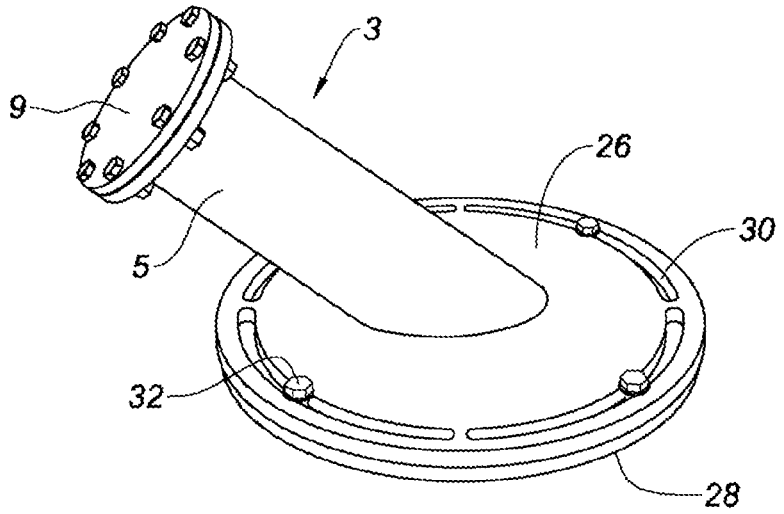

As shown in FIGS. 9 and 10, a second manner of producing such a steerable technical access 3 may be to provide that the pipe segment 5 for that technical access is mounted on a platen 26 suitable for being rotatably mounted on an annular plate 28 secured to said tank 1.

In the alternative illustrated in FIG. 9, the platen 26 is suitable for being pivotably mounted by a ball bearing on the annular plate 28.

In the alternative illustrated in FIG. 10, the platen 26 includes annular slots 30 capable of cooperating with screws and nuts 32 secured to said annular plate 28.

In this last alternative, to pump the liquid, one then begins by attaching the technical access on the plate.

Outside these pumping periods, the technical access is disconnected from the tank, which makes it possible to eliminate the corrosion problems in particular of the ball bearings of the alternative shown in FIG. 9.

The invention claimed is:

1. A method for discharging liquid from a tank of a stricken ship that is partially submerged and having no pumping means, or having pumping means that are at least partially damaged, and/or requiring additional pumping means, said tank including at least one technical access, the method comprising the steps of:

opening said technical access, introducing a rigid pipe into the interior of the tank through the technical access, wherein the rigid pipe has a diameter strictly smaller than that of the technical access, placing, inside this rigid pipe, a pump comprising at least one of a lift pump that is positioned in the lower portion of said pipe, and a suction pump that is positioned in the upper portion of said pipe, wherein the rigid pipe is inclined so as to pump the liquid at different points of the inside of the tank.

2. The method according to claim 1, wherein said pump is sealably connected with said rigid pipe and has no delivery or suction hose, such that it is possible to lift or suction said liquid through said rigid pipe.

3. The method according to any claim 1, wherein said pump is a lift pump, and it is lowered into the rigid pipe using a suspension cable.

4. The method according to claim 1, wherein said pump is a lift pump, and it is lowered into the rigid pipe using an electrical or hydraulic power cable of the pump.

5. The method according to claim 1, wherein the pump is a lift pump and is equipped with a delivery hose, said pump being lowered into the rigid pipe using the delivery hose.

6. The method according to claim 1, wherein the pump is a suction pump and is equipped with a suction hose, the hose connected to said pump positioned on said technical access being lowered into the rigid pipe.

7. The method according to claim 1, wherein the tank includes several technical accesses, and wherein the rigid pipe and the pump, with associated delivery or suction hose, are introduced into at least one of said technical accesses.

8. The method according to claim 7, when the technical accesses are inclined toward the corners of the tank, the rigid pipe and the pump, with the associated delivery or suction hose, are introduced into the technical accesses so as to pump the liquid located in the corners of the tank.

* * * * *